US007172478B2

(12) United States Patent
Blair et al.

(10) Patent No.: US 7,172,478 B2
(45) Date of Patent: Feb. 6, 2007

(54) TORSIONAL CONTROL BOAT THROTTLE SYSTEM

(75) Inventors: Charles S. Blair, 360 Encina Ave., Redwood City, CA (US) 94061; Stephen Lee Olson, Los Altos, CA (US)

(73) Assignee: Charles S. Blair, Redwood City, CA (US)

( * ) Notice: Subject to any disclaimer, the term of this patent is extended or adjusted under 35 U.S.C. 154(b) by 16 days.

(21) Appl. No.: 11/063,700

(22) Filed: Feb. 22, 2005

(65) Prior Publication Data

US 2006/0189226 A1 Aug. 24, 2006

(51) Int. Cl.
*B60W 10/04* (2006.01)

(52) U.S. Cl. ..... 440/87

(58) Field of Classification Search ..... 440/84, 440/86, 87

See application file for complete search history.

(56) References Cited

U.S. PATENT DOCUMENTS 3,174,357 A * 3/1965 Conklin ..... 74/480 B
5,180,320 A * 1/1993 Calamia et al. ..... 440/61 R
5,453,030 A * 9/1995 Broussard ..... 440/6
5,967,867 A * 10/1999 Rinzaki et al. ..... 440/87
6,053,781 A 4/2000 Littleton
6,093,066 A * 7/2000 Isogawa et al. ..... 440/63
6,260,278 B1 * 7/2001 Faher ..... 30/276
6,672,412 B1 1/2004 Charlson
6,684,803 B1 2/2004 Dickson
6,776,671 B2 8/2004 Dunn
6,805,064 B1 10/2004 Andersen
2001/0010987 A1 8/2001 Fadeley et al.
2004/0069198 A1 * 4/2004 Hundertmark ..... 114/144 R

* cited by examiner

*Primary Examiner*—Stephen Avila
(74) *Attorney, Agent, or Firm*—Douglas C. Limbach; Bozicevic, Field & Francis LLP

(57) ABSTRACT

A torsional throttle control system is provided that may include any of a number of features. One feature of the throttle control system is twist-style grip that has an axis with an angle adjustable to a housing. Another feature comprises trim and/or outboard motor control(s) atop the grip. Yet another feature comprises the internal mechanism adapted to effect throttle control. Methods associated with use of the throttle control hardware and systems including a boat are also covered.

10 Claims, 4 Drawing Sheets

TORSIONAL CONTROL BOAT THROTTLE SYSTEM

FIELD OF THE INVENTION

The present invention relates to throttle controls for vehicles, particular watercraft. The invention also relates to the manner of converting user control input to output, as well as translation of that output to action at a remote location.

BACKGROUND OF THE INVENTION

A number of known throttle controls for watercraft employ a twist-grip type of interface connected to an electronic control unit. These are found in connection with electric trolling motors. Twist of the grip controls motor speed. Typically, the grip also serves as a tiller, in which its point dictates the direction of the motor connected thereto by a tube or shaft.

More sophisticated throttle control systems are shown in U.S. Pat. Nos. 6,053,781 and 6,776,671. In each patent, the tiller/throttle grip assembly is removed from the propeller tube and setup at a remote location. In the '781 patent, the direction the propeller points is controlled by a separate lever arm with push-pull ropes/cables wrapped around a component connected to the motor tube. The motor control unit with its grip is located amidship oriented vertically. In the '671 patent, the motor control head and throttle control grip are mounted alongside the pilot's seat. The control head is mounted on a rod so that it can rotate around the axis that is in-line with the boat to actuate a linkage assembly attached to propeller tube to effect steering.

While these systems offer benefits, their use is contemplated only in connection with electric trolling motors. Furthermore, neither system offers angular adjustability of the throttle grip independent of steering control. In the '781 patent, no angular adjustability is available with the fixed unit. In the '671 patent one cannot simply adjust the angle of the grip to a desirable position while operating the boat, since to do so would set an unintended course. Moreover, trolling motors are suited only for driving a small boat at a speed of a few knots/mph, and in calm water. The inventor hereof has appreciated the benefits of a throttle grip type system for use in a vastly different context. Particularly, the present invention finds use in high power speedboats as a means of control for the primary source of propulsion. Benefits and advantages of the current system are elaborated upon below.

SUMMARY OF THE INVENTION

The present invention is a throttle assembly using a twist grip type user interface. The throttle control assembly is provided for use in connection with powerboats, especially those suited for use in rough (open ocean) water and/or at high speed (i.e., greater than, for example, 30 knots/35 mph) in racing, etc.

The throttle assembly of the present invention typically controls at least one large internal combustion engine. The present invention offers particular advantages in connection with racing boats in which the user sits in a tight cockpit and the boat is planning across the water at very high speeds (upwards of 75 mph in a typical race). At such speeds, the wakes of other boats or wave action produces an extremely rough or "bumpy" ride. A grip-style throttle according to the present invention, then, provides a user something stable to hold onto in order to help maintain body position, and avoid injury as is common from banging fingers, elbows etc. while being tossed around in the cockpit of a scarab or another type of racing boat.

In one aspect of the invention, the grip drives a mechanical gear system that operates a control cable. The cable may be coupled directly to a lever arm attached to the throttle shaft of a marine engine or motor. Alternatively, the cable can actuate a rack in a rack-and-pinion arrangement in which the pinion is mounted on the throttle shaft itself. In this manner, truly linear throttle control can be achieved since change in lever arm angle is avoided.

One aspect of the invention concerns the engine-side rack-and-pinion itself, alone or in combination with the throttle grip assembly. Another aspect of the invention concerns a throttle grip that is adjustable by a user (in use or adjusted and then set to a position) relative to a fixed housing. The adjustment serves to optimize user comfort and/or available support.

Yet another aspect of the invention provides control features atop the throttle grip. These may be buttons, switches, etc. which are preferably positioned within reach of the user's thumb so that they may be actuated without changing grip on the throttle. These controls advantageously actuate right and/or left trim tabs and/or outboard motor up/down adjustment. The throttle grip is advantageously shaped both to provide space for mounting the control features and for facilitating reach to actuate the controls. As such, the grip may have an ergonomic shape, with a surface for mounting the controls canted towards the thumb position for a user.

The invention also comprises methods, in which the methods may involve use of the subject devices. The methods may be practiced with other devices than those described herein. Yet, the acts associated with the use of such other devices will be typically be in accordance with those associated with the devices described herein.

In any case, one method according to the present invention involves operating a boat in which the user grasping a steering wheel with one hand and the throttle control with the second hand, and substantially maintains a body position while effecting throttle control by supporting the body from forward and aft movement with the wheel and throttle control. The user is able to do so since throttle control merely requires twisting the handgrip. In comparison, where one or more levers are the means of throttle control, the back and forth movement of the levers alter body position. Further, it is not possible to support the body against forward and aft movement by grasping a throttle lever free to move in the same plane. The method may further comprise adjusting at least one of trim and motor up/down without releasing the throttle grip.

Another method according to the invention includes grasping a throttle control with one hand and adjusting at least one of trim and motor up/down with that hand while grasping the throttle control. Typically, this will be accomplished using the thumb. The method advantageously further comprises grasping a steering wheel with the second hand while grasping the throttle control with the first hand. Most advantageously, the throttle is a grip-type twist throttle so that the user can maintain a stable position while operating the boat.

BRIEF DESCRIPTION OF THE DRAWINGS

Each of the figures diagrammatically illustrates aspects of the invention. Of these.

Variation of the invention from that shown in the figures is contemplated.

DETAILED DESCRIPTION

The following description focuses on one variation of the present invention. The variation of the invention is to be taken as a non-limiting example. It is to be understood that the invention is not limited to particular variation(s) set forth and may, of course, vary. Changes may be made to the invention described and equivalents may be substituted (both presently know and future-developed) without departing from the true spirit and scope of the invention. In addition, modifications may be made to adapt a particular situation, material, composition of matter, process, process act(s) or step(s) to the objective(s), spirit or scope of the present invention.

Figure 1A:
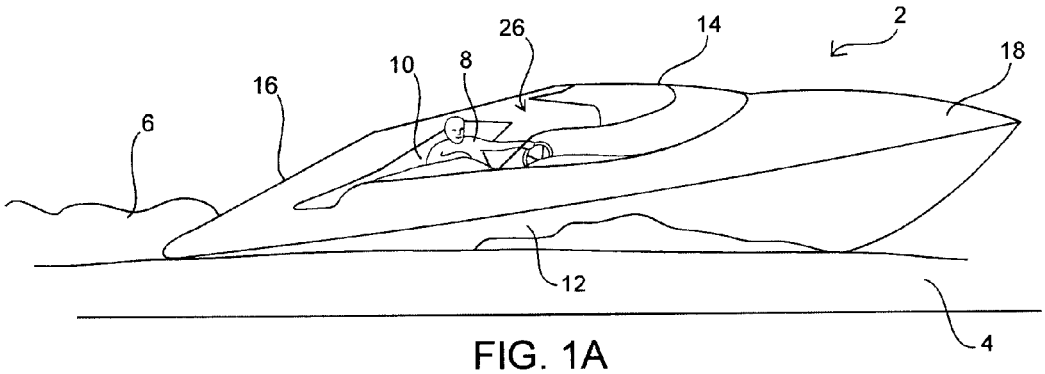
FIG. 1A is an oblique view of the type of boat with which the invention is advantageously used.

FIG. 1A shows a "scarab" type speedboat 2 banking or turning at high speed across the water 4. As shown, it produces a substantial wake 6. An operator or pilot 8 sits in a seat 10 located at the starboard side 12 of the watercraft. A co-pilot (not shown) would typically sit to the port side 14 of the vessel. The present invention is advantageously used in connection with such a watercraft. However, the invention may be put to good use with other types of boats.

Figure 1B:
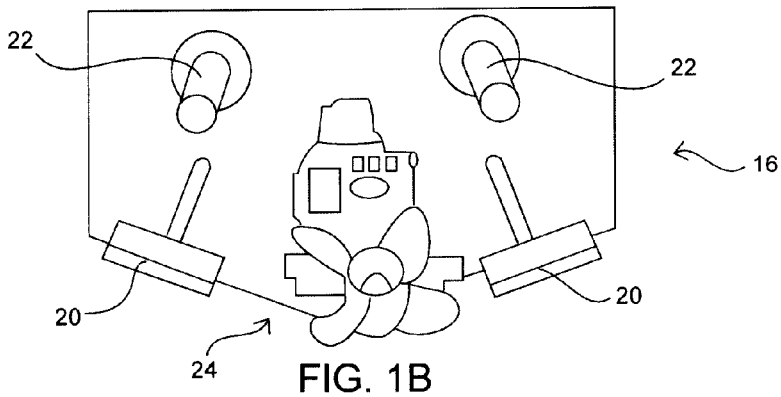
FIG. 1B is a partial view of the stem of the boat.
Figure 1C:
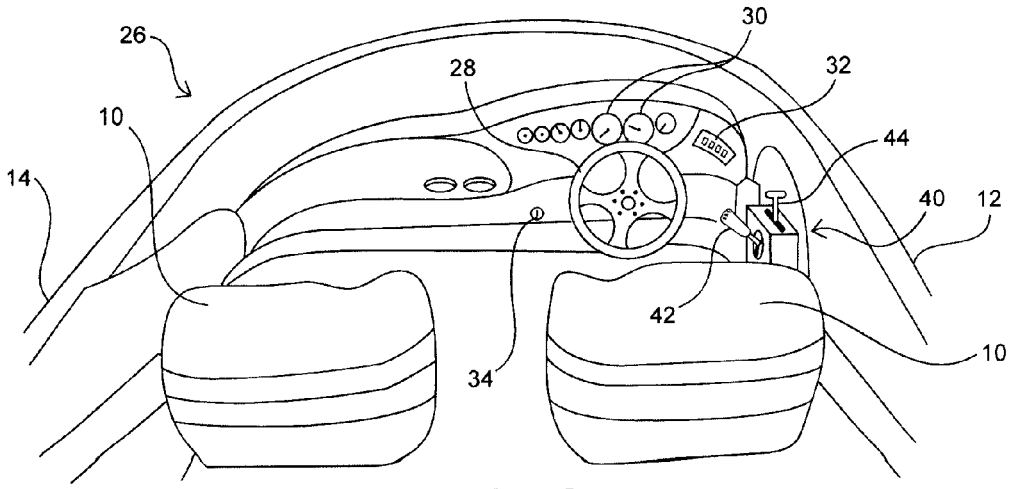
FIG. 1C is an aerial view of the helm of the boat, including a throttle controller according to the present invention.

FIG. 1B provides a partial view of the stem 16 of boat 2 opposite bow 18. Trim tabs 20, exhaust pipes 22, and outboard engine 24 components are shown. FIG. 1C shows the cockpit of boat 26 including chairs 10, wheel 28, gauges 30, switch bank 32, ignition 34 and a control system 40 according to the present invention.

In use, the pilot or captain of the vessel will steer with the left hand and control engine direction and speed with the right hand using controller 40. Since the controller grip 42 is fixed in a forward-aft direction (in contrast to) the gear selector 44, the throttle control grip offers a stable interface for support.

Figure 2A:
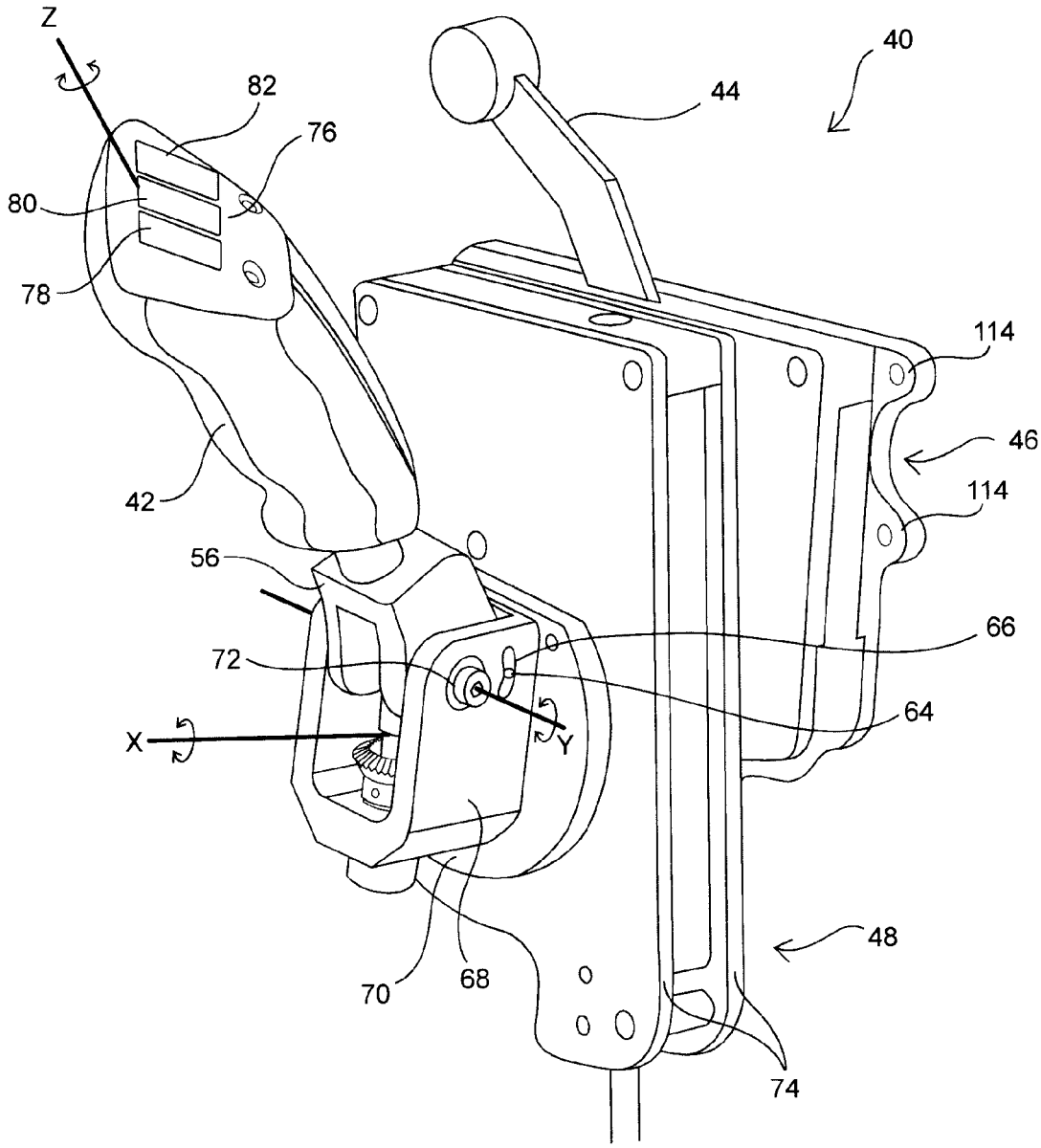
FIG. 2A shows an oblique overview of the throttle assembly.
Figure 2B:
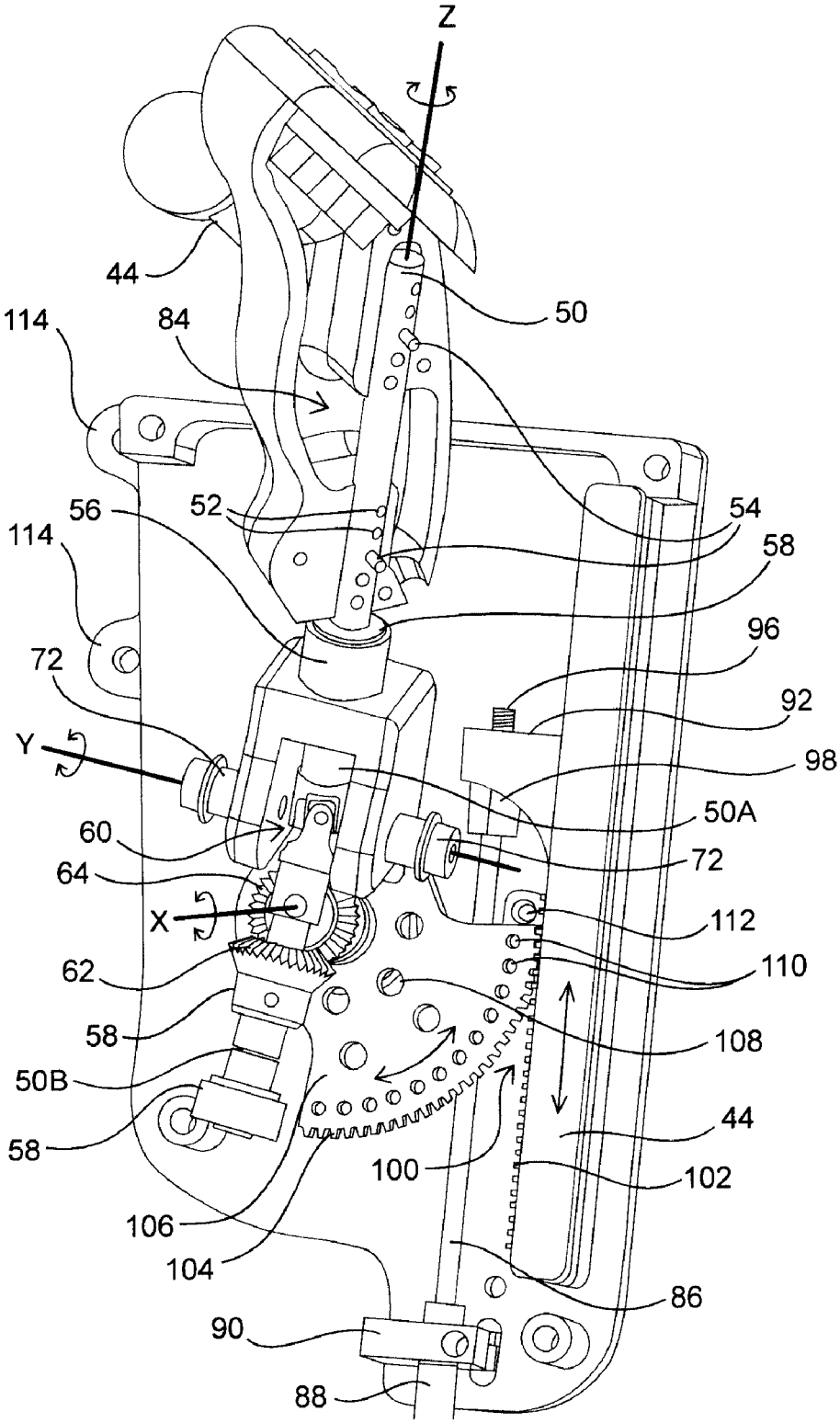
FIG. 2B details the interior of the throttle assembly in oblique cut-away view.

Further details of the subject throttle controller are better appreciated in reference to FIGS. 2A and 2B. The former figure shows a fully assembled view of control package 40; the later figure a cutaway view of the throttle control portion of the device.

The gear selector arm 44 allows the user to select the direction in which to propel the boat by switching the transmission (not shown) between forward and reverse. Selector 44 and its associated box 46 are not unique, and may be constructed as known in the art. However, in combination with the throttle control mechanism of the present invention, a unique control system 40 is hereby provided.

As for those features particular to the inventive controller, a throttle control assembly or subassembly 48 comprises throttle grip or handle 42. The handle is mounted upon a shaft 50. Multiple position locations 52 may be selected from which to secure the handle to the shaft by mating pins 52 to best accommodate a variety of uses or preferred positions. The adjustment holes may be offset around the body of the shaft to allow for selecting a position for the grip rotated around the Z-axis shown. To provide clearance for one another, the adjustment locations may be provided in a sort of "spiral staircase" arrangement as shown. Alternatively, a smooth shaft may be provided against which one or more setscrews are locked to secure position at different "heights" along a Z-axis or different rotated "home" or "start" grip positions around the shaft.

Shaft 50 may be received within a bracket 56 and be supported by a bearing 58. Shaft 50 may be flexible, include a flexible section, or include a U-joint (universal joint) 60 between a proximal section "A" and a distal section "B". In either case, an input bevel gear 62 driven by the handle meshes with an output bevel gear 64 to transform the motion about the grip axis (Z-axis) to motion useful for throttle control. Additional support bearings 58 may be provided for the distal section of the shaft.

Providing a flexible shaft, shaft section or a U-joint 60 as shown allows for the grip to be adjusted about an axis Y in a plane relative to the fixed body of the device. As noted, such an adjustment offers improvement for user comfort in use as well as the option of moving the grip out of the way for cockpit entry or exit. The degree of adjustability provided may range from about 30 to about 90 degrees. By way of a pin 64 captured within in a way 66, or by some other stop means, travel may be limited to a desired range. Detent features may also be provided to releasable secure or give a tactile indication of movement or progression between positions.

When a U-joint is employed for angular adjustment, the system may employ a housing 68 to support the bracket 56 through which shaft 50 is rotationally received. Housing 68 may be mounted to a base 70. Regardless, pins or should bolts 72 supported by housing provide an axis of rotation for the referenced angular adjustment of the grip relative to base 70 and/or plates 74 to which the base is affixed.

Adjustment of the grip assembly about an X-axis as shown is also contemplated. Housing 68 and/or base 70 may be adjusted to a desired position and locked down to one or more of the control body plate(s) 74. In order to serve the desired support function, fixing the position about the X-axis by pins, set screws, etc. is important in order to avoid inadvertent movement or slippage of the grip 42 in the direction of movement when a user is bracing his/herself with it (possibly in combination with wheel 28). Likewise, rotation about axis X should not be so great as to result in turning axis Y far from horizontal. In other words, adjustment around the X-axis should be limited to about +/−15 degrees.

Regarding grip 42 configuration, three buttons are shown upon a canted head 76 of the handle. Button 78 operates the left trim tab, button 80 manipulates outdrive in and out, and button 82 operates the right trim tab. The grip body is shaped to mimic the natural curve of the human hand to provide better grip and allow reach to actuate the buttons with the thumb while maintaining a grip on the handle. Wiring is routed within hollows 84 of the grip or as otherwise convenient.

As for throttle assembly output, the system is set to pull a throttle cable 86 within a cable housing 88. The cable housing may be attached to plate 74 by a clamp block 90. In a preferred variation of the invention, the end of cable 86 is connected at a block 92 to a slide 94. The cable may comprise a threaded end fitting or section 96. A jam nut 98 may be provided to lock the threaded section within threading inside block 92.

In the preferred arrangement, slide 94 forms part of a rack and pinion assembly 100. Rack gear teeth 102 mesh with pinion gear teeth 104. The pinion gear itself 106 may comprise a section or sector of a full round gear. It may include lightening holes 108. It preferably includes holes or depressions 110 to interface with a spring loaded ball 112 to provide a detent means. The detent means provides tactile feedback providing a user with an indication of advancement across the range of throttle grip rotation. Alternatively, a damped or smooth frictional feel to grip rotation may be desired. Naturally, any type of action may be employed.

Regarding the action produced by grip rotation, reference to FIG. 2B illustrates how rotation of bevel gear 62 turns bevel gear 64, that—in turn—rotates pinion 106 to translate rack/slider 94, to push and pull throttle cable 86. Alternatively, pinion 104 could be replaced by a cam or lever arm attached to the throttle cable. Other output options exist as well. In any case, at some stage, output from the second bevel gear drives cable pull.

Another noteworthy option concerns the manner in which the throttle control and/or gear selector assembly is installed in a boat. The combined unit 40 may simply be mounted to existing boat hardware or to custom brackets using mounting bosses 114. Alternatively, an existing gear selector setup may be employed and only the throttle control section 48 of the system retrofitted to the existing setup. Still further, the system may be integrated into the original control design of a boat. In which case, significant variation to the configuration of at least the device housing is contemplated. Still further, any boat may be modified by supplying a custom combing insert to better accommodate a stock throttle control system according to the present invention. Such a wall insert to the boat would allow a user to better recess the subject control housing or box.

Figure 3:
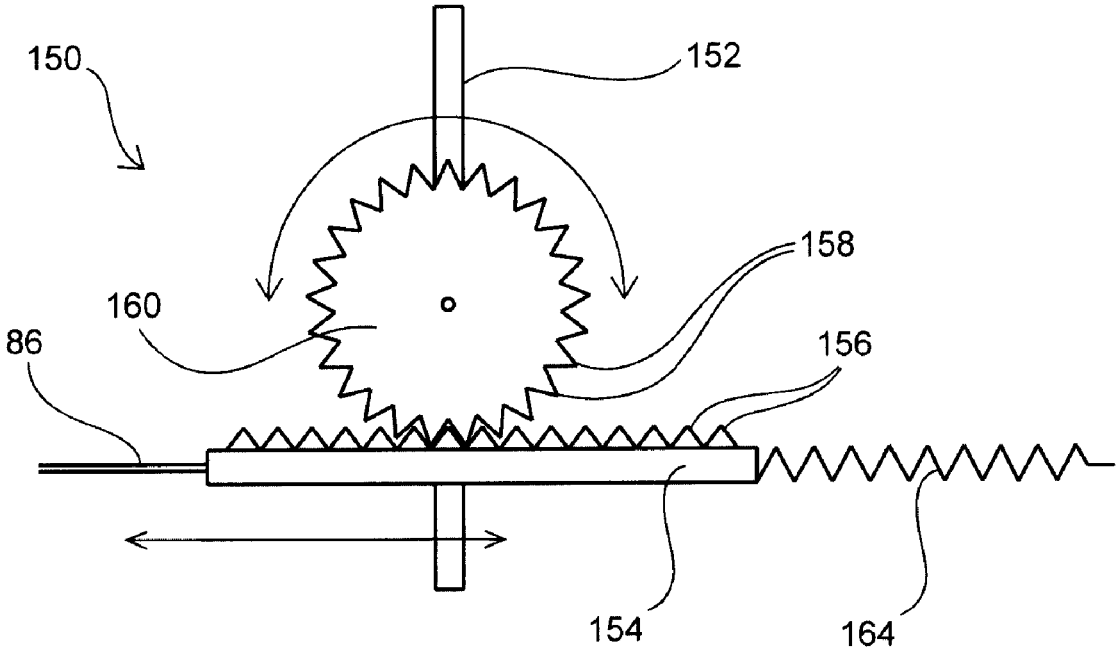
FIG. 3 illustrates an engine-side throttle control system.

Another aspect of the invention concerns the manner in which cable pull from the control side of systems is handled at the engine side. The cable can actuate the motor throttle in a conventional manner. However, FIG. 3 shows a more preferred approach where a transfer mechanism 150 according to the present invention operates an engine throttle shaft 152. Here, cable 86 is affixed to throttle rack 154. As the rack is pulled by the throttle cable, rack teeth 156 engage throttle pinion gear teeth 158, causing throttle pinion gear 160 to rotate. The throttle pinion gear is affixed to throttle shaft 152 by a setscrew, a splined connection or other conventional means. Throttle shaft 152 may be affixed to butterfly valve 162. As the butterfly valve position is open, airflow to the engine is increased, resulting in increased combustion in the engine, and higher boat speed. An extension spring 164 may be provided in the system to bias cable pull and help return the rack and pinion to its previous configuration when the cable is "pushed" within the housing. The system in FIG. 3 is especially advantageous for use with the system as illustrated in FIGS. 2A and 2B because it offers a 1:1 correspondence of user input to engine throttle action.

As for additional details pertinent to the present invention, materials and manufacturing techniques may be employed as within the level of those with skill in the relevant art. The same may hold true with respect to method-based aspects of the invention in terms of additional acts a commonly or logically employed. Also, it is contemplated that any optional feature of the inventive variations described may be set forth and claimed independently, or in combination with any one or more of the features described herein. Likewise, reference to a singular item, includes the possibility that there are plural of the same items present. More specifically, as used herein and in the appended claims, the singular forms "a," "and," "said," and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Unless defined otherwise herein, all technical and scientific terms used herein have the same meaning as commonly understood by one of ordinary skill in the art to which this invention belongs.

I claim:

1. A throttle control comprising:

a twist handle, the handle connected to a shaft with a first bevel gear toward a distal end of the shaft, a second bevel gear meshing with the first bevel gear, wherein rotation of the handle about an axis of the shaft provides an output from the second bevel gear for throttle control, and wherein an axis of the twist handle is adjustable relative to a fixed housing.

2. The assembly of claim 1, wherein the shaft includes a U-joint.

3. The assembly of claim 1, wherein the shaft is adjustable between about 15 and about 90 degrees.

4. The assembly of claim 1, wherein the second bevel drives a pinion gear meshing with a rack gear, and the rack gear provides an output travel for the device.

5. The assembly of claim 1, wherein the pinion gear comprises a sector, wherein a ball detent interfaces with detent positions spaced around the sector.

6. The assembly of claim 1, a detent means is provided for the handle adjustment.

7. The assembly of claim 1, further comprising at least one of trim and motor up/down buttons atop the handle.

8. The assembly of claim 1 set in a housing, the housing further comprising a gear shifter.

9. The assembly of claim 1, further comprising a cable, the cable connected to a rack gear meshing with a pinion gear, the pinion gear positioned to actuate fuel supply to an engine or motor.

10. A boat comprising:

a hull, at least one motor, and a throttle control selected from one of the throttle controls described in claim 1, mounted to or integrated with the boat.

* * * * *